US005130637A

United States Patent [19]

Sugo

[11] Patent Number: 5,130,637

[45] Date of Patent: Jul. 14, 1992

[54] CONSTANT VOLTAGE GENERATING CIRCUIT

[75] Inventor: Yasuhisa Sugo, Hachiouji, Japan

[73] Assignee: Fujitsu Ltd., Kawasaki, Japan

[21] Appl. No.: 648,849

[22] Filed: Jan. 31, 1991

[30] Foreign Application Priority Data

Jan. 31, 1990 [JP] Japan ..... 2-18981

[51] Int. Cl.[5] ..... G05F 3/20

[52] U.S. Cl. ..... 323/314; 307/264; 307/446; 307/475

[58] Field of Search ..... 323/313, 314, 315, 316; 307/296.1, 296.6, 296.7, 264, 446, 475

[56] References Cited

U.S. PATENT DOCUMENTS 3,781,648 12/1973 Owens ..... 323/314
4,339,707 7/1982 Gorecki ..... 323/313
4,713,600 12/1987 Tsugaru et al. ..... 307/264
4,725,770 2/1988 Okutsu et al. ..... 323/313
4,794,317 12/1988 van Tran ..... 307/475

*Primary Examiner*—Peter S. Wong
*Attorney, Agent, or Firm*—Staas & Halsey

[57] ABSTRACT

A constant voltage generating circuit includes a first power supply line coupled to an external power supply line, at least one second power supply line having a voltage different from that of the first power supply line, a level shift circuit having at least one transistor coupled between the first power supply line and the second power supply line, a resistor having one end connected to one of the first and second power supply lines and other end coupled to a base of a transistor provided at a final stage of the level shift circuit, and a current control circuit operatively connected between the other end of the resistor and another of the first and second power supply lines. The current control circuit suitably controls current flowing in the resistor. As a result, it is possible to continually feed a constant voltage irrespective of a fluctuation in temperature, power supply voltage, or the like.

7 Claims, 4 Drawing Sheets

CONSTANT VOLTAGE GENERATING CIRCUIT

BACKGROUND OF THE INVENTION

1. Field of the Invention

The present invention relates to a constant voltage generating circuit, more particularly, to a constitution of a circuit which feeds a constant voltage to a bipolar complementary metal oxide semiconductor (Bi-CMOS) circuit using a plurality of power supply voltages.

2. Description of the Related Art

A typical Bi-CMOS device including bipolar transistors and MOS transistors by mixture in an identical chip is usually constituted to be operated by a single power supply voltage fed from the outside of the chip. Also, in the case of use of a plurality of power supply voltages as well, some of the power supply voltages are fed from the outside of the chip. In this case, the other power supply voltages are fed by a voltage generating circuit which is provided within the chip and receives the external power supply voltages. Also, since dispersion between each power supply voltage is not concerned with each other, it becomes necessary to sufficiently assure an operation margin (voltage values necessary for the exact and reliable operation of the device). To this end, the voltage generating circuit must feed a constant voltage or voltages at all times even if the external power supply voltages fluctuate due to a change in temperature, and the like.

In a known voltage generating circuit, however, the above ideal constitution has not been proposed. Problems in the prior art will be explained in detail later.

SUMMARY OF THE INVENTION

An object of the present invention is to provide a constant voltage generating circuit capable of continually feeding a constant voltage irrespective of a fluctuation in temperature, power supply voltage, or the like.

According to the present invention, there is provided a constant voltage generating circuit including: a first power supply line coupled to an external power supply line; at least one second power supply line having a voltage different from that of the first power supply line; a level shift circuit having at least one transistor coupled between the first power supply line and the second power supply line; a resistor having one end connected to one of the first and second power supply lines and other end coupled to a base of a transistor provided at a final stage of the level shift circuit; and a current control circuit operatively connected between the other end of the resistor and another of the first and second power supply lines and controlling current flowing in the resistor.

BRIEF DESCRIPTION OF THE DRAWINGS

Other objects and features of the present invention will be described hereinafter in detail by way of preferred embodiments with reference to the accompanying drawings, in which.

DESCRIPTION OF THE PREFERRED EMBODIMENTS

For a better understanding of the preferred embodiments of the present invention, the problem in the prior art will be explained with reference to FIGS. 1 and 2.

Note, the circuit constitution shown in FIG. 1 applies not only to the prior art but also to the preferred embodiments of the present invention as explained later.

Figure 1:
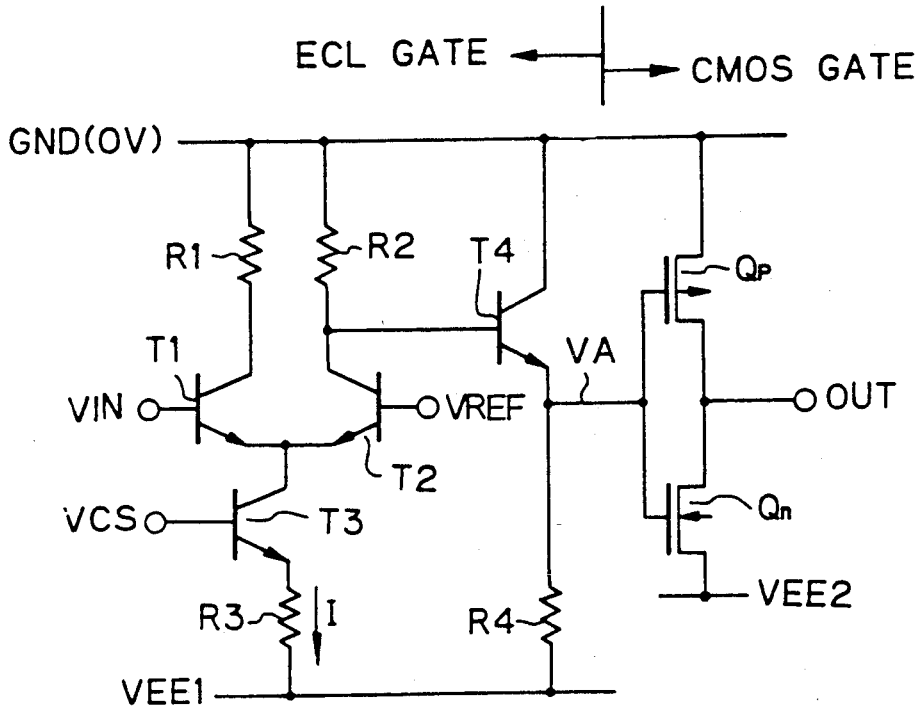
FIG. 1 is a circuit diagram illustrating a constitution of a Bi-CMOS circuit.

FIG. 1 illustrates a constitution of a Bi-CMOS circuit. The illustrated circuit shows a constitution in which a CMOS gate is directly driven by an ECL gate.

Note, in the description below, a term "transistor" indicates an NPN type bipolar transistor so long as a specific definition is not added thereto.

The ECL gate is constituted by: a pair of emitter-coupled transistors T1 and T2 responsive to an input signal VIN and a reference voltage signal VREF, respectively; resistors R1 and R2 connected between a ground line GND (0V) and each collector of the transistors T1, T2, respectively; a transistor T3 having a collector connected to the common emitter of the transistors T1, T2 and responsive to a predetermined bias voltage VCS; a resistor R3 connected between an emitter of the transistor T3 and a negative potential power supply line VEE1; a transistor T4 having a collector connected to the ground line GND and responsive to a collector potential of the transistor T2; and a resistor R4 connected between an emitter of the transistor T4 and the power supply line VEE1. Note, the transistor T3 and the resistor R3 in combination constitute a constant current source and the constant current value (I) is expressed by the following equation:

$$I=(VCS-VEE1-V_{BE})/R3,$$

where $V_{BE}$ indicates a base-emitter voltage of the transistor T3.

Also, the CMOS gate is constituted by a P-channel MOS transistor Qp and an N-channel MOS transistor Qn connected in series between the ground line GND and a negative potential power supply line VEE2 (higher than the potential VEE1) and responsive to an output of the ECL gate (an emitter potential VA of the transistor T4), respectively.

Since the logical level of the ECL gate is different from that of the CMOS gate, a level conversion circuit needs to be usually inserted between them in the connection of both of the gates. Note, where the power supply voltage VEE1 of the ECL gate is normally set to −5.2 [V] and the power supply voltage VEE2 of the CMOS gate is selected to be −3.0 [V], the level conversion circuit is not needed.

Figure 2:
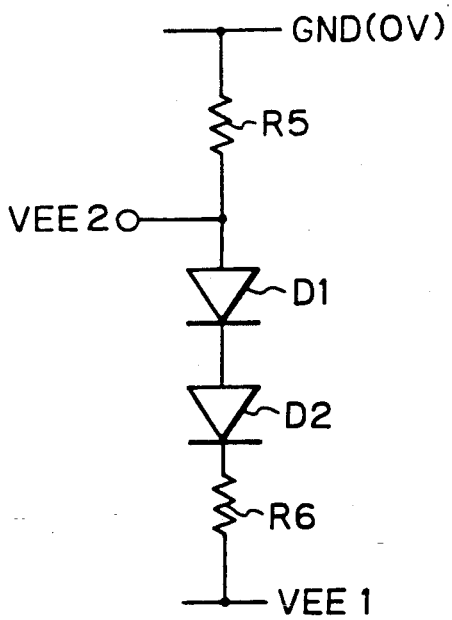
Fig. 2 PRIOR ART
FIG. 2 is a circuit diagram illustrating a constitution of a prior art constant voltage generating circuit.

In this case, the power supply voltage VEE1 of the ECL gate is fed from an external of the circuit, e.g., from the outside of the chip, and the power supply voltage VEE2 of the CMOS gate is fed by, for example, a constant voltage generating circuit shown in FIG. 2. The illustrated circuit is constituted by a resistor R5, diodes D1, D2 and a resistor R6 connected in series between the ground line GND and the power supply line VEE1, and the power supply voltage VEE2 is taken from an anode terminal of the diode D1.

In the constitution of FIG. 1, the output VA of the ECL gate is determined on the basis of the ground level GND and a lower ("L") level VA(L) of the potential VA is expressed by the following equation:

$$VA(L) = -(R2 \cdot I + V_{BE}),$$

where $V_{BE}$ indicates a base-emitter voltage of the transistor T4.

When the output VA of the ECL gate is at "L" level, the subsequent CMOS gate must be in a state in which the P-channel MOS transistor Qp is turned ON and the N-channel MOS transistor Qn is in a cut-off state. Therefore, to stably drive the CMOS gate by means of the "L" level potential VA(L), it is essential to satisfy the condition that a potential difference between the "L" level potential VA(L) and the power supply voltage VEE2 is smaller than a threshold voltage (Vth) of the N-channel MOS transistor Qn. The condition must be satisfied even in case of fluctuations in temperature, power supply voltages VEE1 and GND, or the like.

According to the circuit constitution of FIG. 2, however, when the power supply voltages VEE1, GND are supplied to the circuit, voltage-current (V-I) characteristics of the diodes D1, D2 are changed due to the fluctuations in temperature, power supply voltages, or the like, and thus a possibility arises in that it is impossible to always satisfy the above condition. Namely, when the output VA of the ECL gate is at "L" level, a possibility occurs in that the N-channel MOS transistor Qn is also turned ON (i.e., misoperation) and thus a large amount of current flows from the ground line GND via the transistors Qp and Qn into the power supply line VEE2 (direct current path). This may cause a deterioration in the chip or a destruction thereof and thus is not preferable.

Next, a preferred embodiment of the present invention will be explained with reference to FIGS. 3 to 5.

Figure 3:
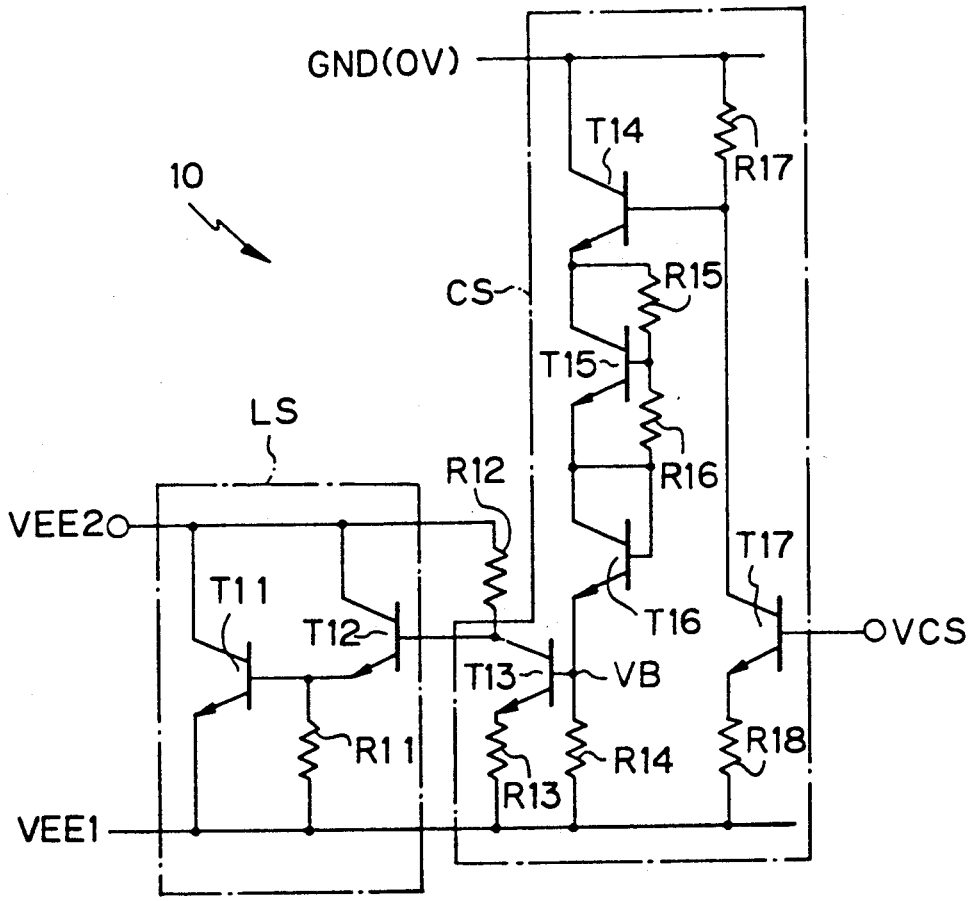
FIG. 3 is a circuit diagram illustrating a constitution of the constant voltage generating circuit according to an embodiment of the present invention.

FIG. 3 illustrates a constitution of the constant voltage generating circuit according to an embodiment of the present invention.

The illustrated constant voltage generating circuit 10, roughly classifying, is constituted by a level shift circuit LS, a resistor R12, and a current control circuit CS for controlling current flowing in the resistor R12 based on a predetermined bias voltage (indicated by reference VB).

The level shift circuit LS includes two transistors T11, T12 coupled in a Darlington connection between a negative potential power supply line VEE1 and a negative potential power supply line VEE2 (higher than the potential VEE1), and a resistor R11 connected between a base of the transistor T11 (an emitter of the transistor T12) and the power supply line VEE1. Also, the resistor R12 is connected between a base of the transistor T12 and the power supply line VEE2. Note, the power supply line VEE1 is connected to a line of a power supply voltage fed from the outside of a chip (see FIG. 4).

The current control circuit CS is constituted by: a transistor T13 having a collector connected to one end of the resistor R12 (the base of the transistor T12) and responsive to the above bias voltage VB; a resistor R13 connected between an emitter of the transistor T13 and the power supply line VEE1; a resistor R14 connected between a base of the transistor T13 and the power supply line VEE1; transistors T14, T15 and T16 connected in series between a ground line GND (0V) and the base of the transistor T13; a resistor R15 connected between a collector and a base of the transistor T15; a resistor R16 connected between the base of the transistor T15 and an emitter thereof (a base of the transistor T16); a resistor R17 connected between the ground line GND and a base of the transistor T14; a transistor T17 having a collector connected to the base of the transistor T14 and responsive to a predetermined bias voltage VCS; and a resistor R18 connected between an emitter of the transistor T17 and the power supply line VEE1.

Note, each resistance value of the resistors employed in the circuit is as follows: R11; 4.0 kΩ, R12; 0.5 kΩ, R13; 0.5 kΩ, R14; 5.0 kΩ, R15; 3.6 kΩ, R16; 7.7 kΩ, R17; 5.0 kΩ, and R14; 2.0 kΩ.

In the above constitution, the potential on the power supply line VEE2 is determined by each of the base-emitter voltages of the transistors T11 and T12, and a voltage drop in the resistor R12, caused by current controlled through the operation of the transistor T13, on the basis of the potential on the power supply line VEE1.

When temperature rises, each base-emitter voltage of the transistors T11, T12 becomes small and the base potential VB of the transistor T13 is accordingly increased. This results in an increase in the current flowing in the transistor T13. Therefore, the voltage drop in the resistor R12 is accordingly increased and thus the potential on the power supply line VEE2 is stabilized.

Where the potential on the power supply line VEE1 fluctuates (falls), the current flowing in the transistor T13 is increased by the amount corresponding to the fall of the potential VEE1 and thus the potential on the power supply line VEE2 is stabilized. This is why the base potential VB of the transistor T13 is substantially constant as against the potential on the ground line GND. On the other hand, where the potential on the power supply line VEE1 fluctuates (rises), the present circuit is brought to the same state as in the above case of the rise of temperature and thus the stabilization of the potential on the power supply line VEE2 is realized.

Figure 4:
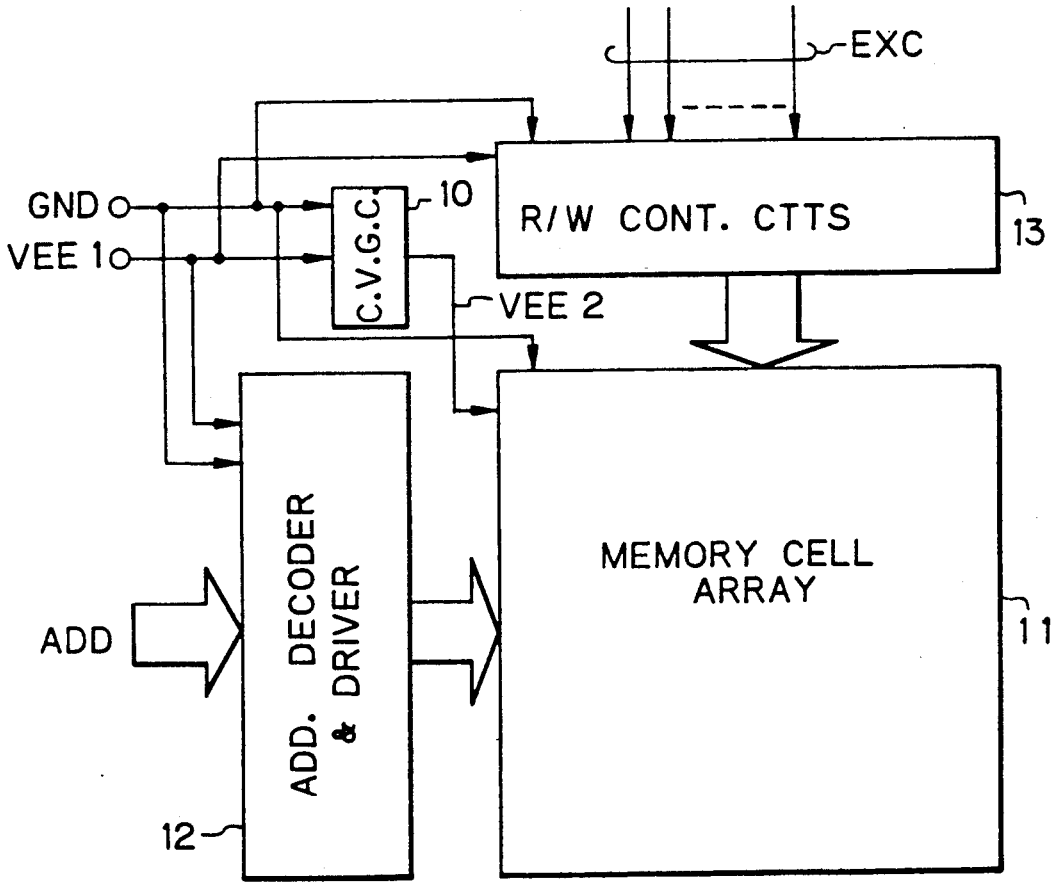
FIG. 4 is a block diagram schematically illustrating a constitution of the SRAM to which the circuit of FIG. 3 is applied.

In the present embodiment, the constant voltage generating circuit 10 of FIG. 3 is applied to a static random access memory (SRAM) shown in FIG. 4, which is incorporated into a semiconductor chip.

In the illustration, reference 11 denotes a memory cell array having a plurality of SRAM cells (not shown) formed by MOS (or CMOS) structure; reference 12 denotes a circuit block formed by ECL structure and connected to external power supply lines VEE1 and GND, for decoding address information ADD fed from the outside of the chip to select a memory cell and driving a word line including the selected memory cell; and reference 13 denotes a circuit block formed by ECL structure and connected to external power supply lines VEE1 and GND, for controlling read/write operations of cell data in response to external control signals EXC. In this constitution, the memory cell array 11 receives the external power supply voltage GND (0V) and a power supply voltage VEE2 generated by the constant voltage generating circuit 10.

Referring back to FIG. 3, a resistance ratio of the resistor R15 to the resistor R16 is selected such that, when the power supply voltage VEE1 fluctuates and rises, the transistor T13 can be prevented from being brought to a cut-off state. Namely, in the ON state of the transistor T13, the resistors R15 and R16 contribute to a stabilization of the base voltage VB.

Figure 5:
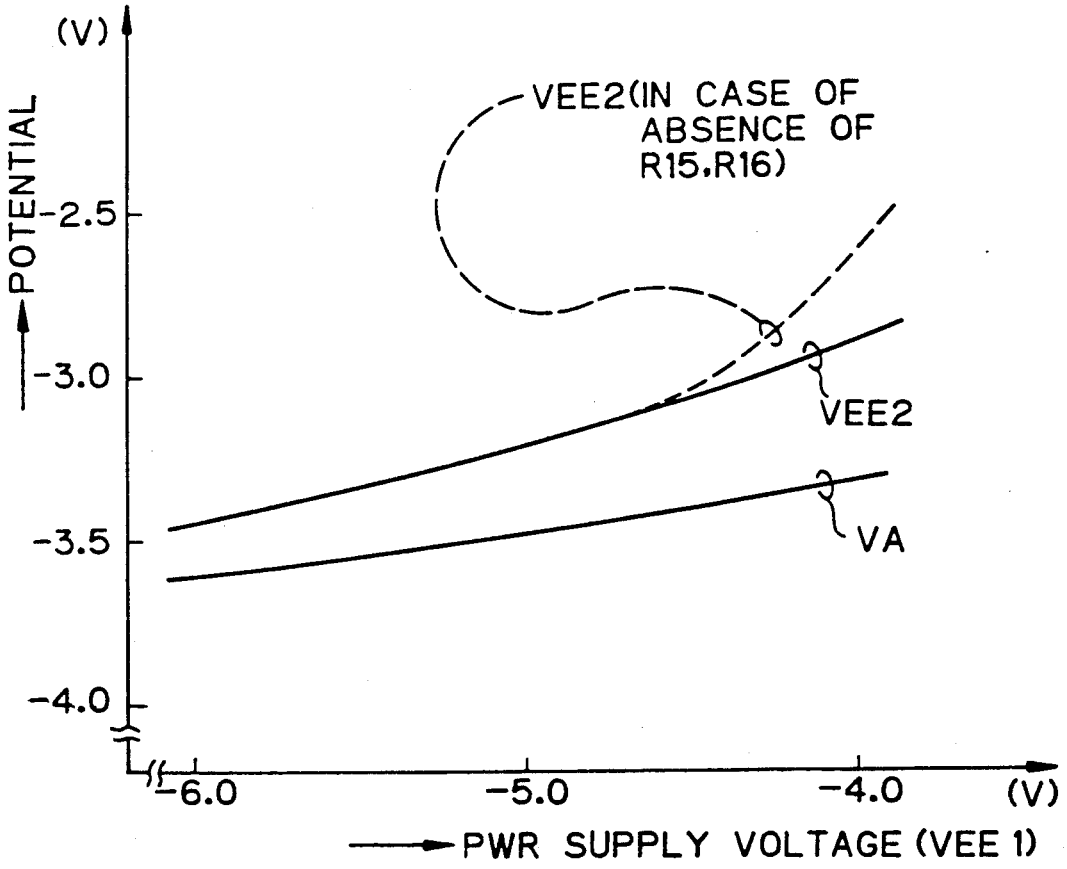
FIG. 5 is a graph showing relationships between each potential and the power supply voltage.

Concretely, as shown in characteristic graphs of FIG. 5, when the resistors R15 and R16 are provided in the circuit, it is possible to control relatively small a change in the power supply voltage VEE2 (shown by a solid line) as against a fluctuation in the power supply voltage VEE1. Contrary to this, where the resistors R15 and R16 are not provided, the change in the power supply voltage VEE2 (shown by a broken line) relatively becomes large with the rise of the power supply voltage VEE1. A great change in the power supply voltage VEE2 may exert an adverse effect on the read/write operations in the memory cell array 11 (see FIG. 4), or may not. Anyway, it is more preferable to provide the resistors R15 and R16.

As explained above, according to the circuit constitution of the present embodiment, the level shift circuit LS and the resistor R12 in combination realize characteristics against the temperature and the power supply voltages, which are equivalent to those of an ECL gate. As a result, it is possible to continually feed the constant voltage (VEE2) irrespective of fluctuations in temperature, power supply voltages, or the like. Therefore, even if the constant voltage generating circuit of the present embodiment is applied to a Bi-CMOS circuit (e.g., shown in FIG. 1), it is possible to remove a possibility of a misoperation as encountered in the prior art.

Although the present invention has been disclosed and described by way of one embodiment, it is apparent to those skilled in the art that other embodiments and modifications of the present invention are possible without departing from the spirit or essential features thereof.

I claim:

1. A constant voltage generating circuit comprising:

a first power supply line coupled to an external power supply line;

at least one second power supply line having a voltage different from that of the first power supply line;

a level shift circuit having at least one transistor coupled between the first power supply line and the second power supply line;

a resistor having one end connected to one of the first and second power supply lines and other end coupled to a base of a transistor provided at a final stage of the level shift circuit; and a current control circuit operatively connected between the other end of the resistor and another of the first and second power supply lines, driven by the external power supply line and controlling current flowing in the resistor.

2. A constant voltage generating circuit as set forth in claim 1, wherein said level shift circuit comprises a plurality of transistors coupled in a Darlington connection between the first and second power supply lines.

3. A constant voltage generating circuit as set forth in claim 1, wherein said current control circuit comprises a first transistor connected in series with said resistor, the first transistor being brought to an ON state in response to a predetermined bias voltage and controlling a magnitude of current flowing in the resistor according to an analog operation in the ON state thereof.

4. A constant voltage generating circuit comprising:

a first power supply line coupled to an external power supply line;

at least one second power supply line having a voltage different from that of the first power supply line;

a level shift circuit having at least one transistor coupled between the first power supply line and the second power supply line;

a resistor having one end connected to one of the first and second power supply lines and other end coupled to a base of a transistor provided at a final stage of the level shift circuit; and a current control circuit operatively connected between the other end of the resistor and another of the first and second power supply lines, driven by the external power supply line and controlling current flowing in the resistor;

and including;

a first transistor connected in series with said resistor, the first transistor being brought to an ON state in response to a predetermined bias voltage and controlling a magnitude of current flowing in the resistor according to an analog operation in the ON state thereof;

second, third and fourth transistors coupled in a series connection a third power supply line coupled to an external power supply line and the first power supply line, an emitter potential of the fourth transistor determining said predetermined bias voltage when all of the second to fourth transistors are brought to ON states.

5. A constant voltage generating circuit as set forth in claim 4, wherein said current control circuit further comprises first and second resistors connected in series between a collector of the third transistor and an emitter thereof, a connection point of the first and second resistors being connected to a base of the third transistor.

6. A constant voltage generating circuit as set forth in claim 5, wherein said current control circuit further comprises a circuit including at least one resistor and a fifth transistor coupled in a series connection between the third power supply line and the first power supply line, the fifth transistor being brought to an ON state in response to another predetermined bias voltage, thereby determining a base potential of said second transistor.

7. A constant voltage generating circuit which feeds a constant voltage to a bipolar complementary MOS circuit using a plurality of power supply voltages, the bipolar complementary MOS circuit including a SRAM cell array formed by complementary MOS structure and a peripheral circuit formed by ECL structure and effecting various controls for the SRAM cell array, wherein the constant voltage generating circuit comprises:

a first power supply line coupled to an external power supply line and connected to the peripheral circuit;

at least one second power supply line having a voltage different from that of the first power supply line and connected to the SRAM cell array;

a level shift circuit having at least one transistor coupled between the first power supply line and the second power supply line;

a resistor having one end connected to one of the first and second power supply lines and other end coupled to a base of a transistor provided at a final stage of the level shift circuit; and a current control circuit operatively connected between the other end of the resistor and another of the first and second power supply lines, driven by the external power supply line and controlling current flowing in the resistor.

* * * * *

UNITED STATES PATENT AND TRADEMARK OFFICE

CERTIFICATE OF CORRECTION

PATENT NO. : 5,130,637

DATED : July 14, 1992

INVENTOR(S) : Yasuhisa SUGO

It is certified that error appears in the above-indentified patent and that said Letters Patent is hereby corrected as shown below:

Col. 5, line 3, change "relatively small a" to --a relatively small--.

Col. 6, line 21, after "connection" insert --between--.

Signed and Sealed this

Third Day of May, 1994

Bruce Lehman

*Attest:*

BRUCE LEHMAN

*Attesting Officer*

*Commissioner of Patents and Trademarks*